United States Patent [19]

Hirata

[11] 4,217,523

[45] Aug. 12, 1980

[54] PHOTOGRAPHIC FLASH DEVICE

[75] Inventor: Shinji Hirata, Higashiosaka, Japan

[73] Assignee: West Electric Co., Ltd., Osaka, Japan

[21] Appl. No.: 850,031

[22] Filed: Nov. 9, 1977

[30] Foreign Application Priority Data

Nov. 18, 1976 [JP] Japan ..... 51/139220

[51] Int. Cl.[2] ..... H05B 41/32

[52] U.S. Cl. ..... 315/241 P; 354/139; 354/149

[58] Field of Search ..... 315/151, 159, 241 P; 354/32, 34, 137, 138, 145, 149, 139

[56] References Cited

U.S. PATENT DOCUMENTS

| | | | |
|---|---|---|---|
| Re. 28,783 | 4/1976 | Ackermann | 315/151 |
| 3,683,233 | 8/1972 | Heintze | 315/241 P X |
| 3,710,701 | 1/1973 | Takishima et al. | 315/241 P X |
| 3,714,872 | 2/1973 | Mashimo | 315/241 P X |
| 3,906,292 | 9/1975 | Takahashi | 315/241 P X |
| 3,978,370 | 8/1976 | Stieringer | 315/159 X |

*Primary Examiner*—Eugene R. LaRoche

*Attorney, Agent, or Firm*—Cushman, Darby & Cushman

[57] ABSTRACT

In a photographic flash device comprising a main capacitor (1) for storing a large electric energy, a gas-discharge flash tube (4) to be lit by the electric energy of the main capacitor (1), a switching circuit (5+9) which switches off the discharging of the flash lamp (1), a control circuit (20) which controls the switching circuit (5+9) in a manner to switch the switching circuit (5+9) off at a sending of a stopping signal from a triggering circuit (20) to the switching circuit (5+9), and a timer circuit which controls, responding to a selected guide number (G.N.) of flash photographing, the time period from the start of flashing of the flash tube (4) to a sending of a stopping signal to the control circuit (20) (namely the time period of flashing), the improvement is that the time period is adjusted responding to the voltage across the main capacitor (1).

6 Claims, 7 Drawing Figures

PHOTOGRAPHIC FLASH DEVICE

BACKGROUND OF THE INVENTION

1. Field of the Invention

This invention relates to an improvement in a gas-discharge tube type photographic flash device.

2. Background of the Invention

Recently, automatic flash devices are constituted to have a function that amount of flashed light (i.e., product of intensity of light and time period of flashing) is automatically controlled by receiving light reflected by the photographic object.

In addition to the abovementioned automatic function, some flash devices are capable of the additional function of flashing light with a pre-selected amount of light, the selection being made by adjusting an electric device such as variable resistor.

FIG. 1 shows one example of such conventional flash device wherein the light flashes with a pre-selected amount of light. In FIG. 1, the positive and negative terminals + and − are connected to a known DC-DC converter not shown in the drawing. A main capacitor 1 is charged up by the DC-DC converter, and at the same time, a second capacitor 18 is charged up by a current flowing through the positive terminal +, a resistor 17, a capacitor 18, a zenor diode 19 and the negative terminal −. When the thyristor 5 is turned ON by means of a thyristor trigger circuit 3, and when a triggering pulse is coupled to a flash tube 4, for example, a xenon lamp, from a flash triggering circuit 2, the flash tube 4 is triggered and starts discharge the electric energy stored in the main capacitor 1. Since the flash tube 4 and the thyristor 5 becomes ON, the electric charge in the capacitor 18 is discharged through the resistor 17, the flash tube 4, the thyristor 5 and the zenor diode 19. Accordingly the zenor voltage appears across both terminals of the zenor diode. Therefore, a third capacitor 16 starts to be charged by the discharge of the second capacitor 18 through the resistor 17, the flash tube 4, thyristor 5 and a variable resistor 15. When the voltage across the terminals of the capacitor 16 reaches a specified level, a thyristor 13 becomes ON. A capacitor 12 is already charged by this time by a current through a resistor 11, the capacitor 12, a primary coil of the transformer 10, and a zenor diode 19. Accordingly, by the turning ON of the thyristor 13, the charge of the capacitor 12 is discharged through the primary coil of the transformer 10, thereby giving a pulse signal th the quenching discharge tube 9. Therefore, the quenching discharge tube 9 becomes ON thereby causing the capacitor 7 to impress an inverse voltage through the quenching discharge tube 9 on the thyristor 5 thereby turning it OFF, hence stopping the discharge current of the flash tube 4.

In the abovementioned conventional circuit, the selection of the amount of the flash light, namely the guide number (G.N.) is made by adjusting variable resistor 15. Namely, by varying the variable resistor 15, the time period of charging up of the third capacitor 16 is selected, and therefore, the time period of flashing of the tube 4, i.e., the amount of the flash light is set by the adjustment of the variable resistor 15. In such devices, when the voltage across the main capacitor 1 is lowered by a voltage drop of a power source battery of the DC-DC converter or by a sequential flashing without sufficient pause time inbetween, the voltage of the second capacitor 18 is lowered, while the zenor voltage of the zenor diode 19 is constant. As shown in FIG. 2, for a larger voltage $V_1$ of the main capacitor 1, the intensity of the flashed light is stronger, and for a smaller voltage $V_2$ the intensity is weaker. On the other hand, the time period of flashing is defined by the zenor voltage and the characteristic of the thyristor 13, the time period $T_1$ from a start of the flash to the turn on of the thyristor 13 is constant as shown in FIG. 2, irrespective of the voltage of the main capacitor 1. Therefore, when the voltage of the main capacitor 1 is lowered by some reason from a designed value, the total amount of the flash light is decreased from a designed value.

SUMMARY OF THE INVENTION

The object of the present invention is to provide an improved photographic flash device capable of presetting its amount of the light, wherein the light amount is adjusted for a variation of the main capacitor voltage in a manner to give a compensated constant light amount irrespective of the main capacitor voltage.

DETAILED DESCRIPTION OF THE INVENTION

Figure 3:
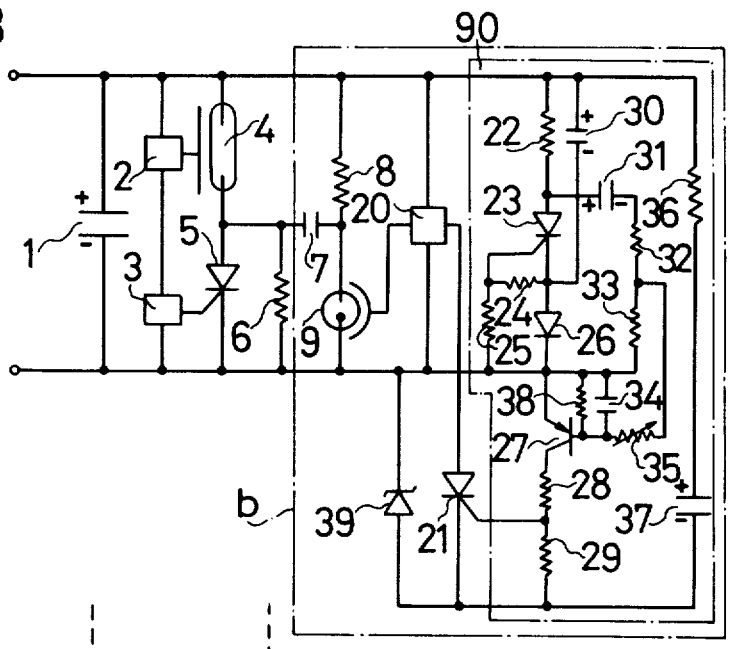
FIG. 3 is a circuit diagram of an example of the present invention.

FIG. 3 shows a circuit diagram of a preferred example of the present invention. A main capacitor 1 is connected to a positive and a negative terminals + and −, which are connected to the positive and a negative output terminals of a known DC-DC converter. A flash tube 4, for example, a xenon gas discharge tube is connected in series with the anode and the cathode of a thyristor 5 across the positive and the negative terminals + and −, respectively. A flash-triggering circuit 2 and a thyristor-triggering circuit 3 are connected in a manner to give a triggering signal to the triggering electrode 4' of the flash tube 4 and to give a triggering signal to the gate of the thyristor 5, respectively. A resistor 6 is connected across the anode and the cathode of the thyristor 5.

In a light amount controlling part "b", a series connection of a resistor 8 and a quenching discharge tube 9 are connected in series across the positive and the negative terminals + and −, and the junction point between the quenching discharge tube 9 and the resistor 8 are connected through a capacitor 7 to the junction point between the flash tube 4 and the thyristor 5.

A controlling circuit 90 is for controlling the time as set by a manual selection by, for example setting a variable resistor 35, in a manner that the time obtained is adjusted to compensate the variation of the main capacitor voltage. In the controlling circuit 90, a resistor 36, a capacitor 37 and a constant voltage element, for example, a zenor diode 39 are connected in series across the positive and the negative terminals + and −. Across the anode and the cathode of the zenor diode 39 are connected resistors 29 and 28 and the collector and the emitter of a transistor 27 in series. A thyristor 21 is connected by the cathode to the anode of the zenor diode 39, by the gate to the junction point between two resistors 28 and 29 and by the anode to an input terminal of a quenching triggering circuit 20, which gives a triggering signal to the quenching discharge tube 9 to turn off the thyristor 5 in a known manner. A resistor 22, the anode and the cathode of the thyristor 23 and a diode 26 are connected in series across the positive terminal + and the negative terminal −. A capacitor 30 is connected between the positive terminal + and the cathode of the thyristor 23. A capacitor 31, a resistor 32 and a resistor 33 are connected in series across the anode of the thyristor 23 and the negative terminal −. A resistor 25 is connected between the gate of the thyristor 23 and the negative terminal −. A resistor 24 is connected between the gate and the cathode of the thyristor 23. The base of the transistor 27 is connected through the variable resistor 35 to the junction point between the resistor 32 and the resistor 33. A resistor 38 and a capacitor 34 are connected in parallel across the base and the emitter of the transistor 27.

Operation of FIG. 1 circuit is as follows:

The main capacitor 1 is charged by the DC-DC converter, and hence, the capacitors 37, 30 and 31 are also charged up in the polarity indicated by the marks + and − thereon.

When the thyristor 5 is turned ON by means of a thyristor trigger circuit 3, and when a triggering pulse is coupled to the flash tube 4 from the triggering circuit 2, the flash tube 4 is triggered and starts to discharge electric energy stored in the main capacitor 1. Since the flash tube 4 and the thyristor 5 become ON, the charge of the capacitor 37 is discharged through the resistor 36, the flash tube 4, the thyristor 5 and the zenor diode 39. Accordingly the zenor voltage across both electrodes of the zenor diode and hence across the collector and the emitter of the transistor 27. At the same time, since the flash tube 4 and the thyristor 5 become ON, the charge of the capacitor 30 is discharged through the flash tube 4, the thyristor 5, the resistor 25 and the resistor 24, thereby producing a triggering voltage across the resistor 24 hence making the thyristor 23 ON. As a result of the turning ON of the thyristor 23, the charge of the capacitor 31 is discharged through the thyristor 23, the diode 26, the resistor 33 and the resistor 32, thereby producing a voltage across the resistor 33. The voltage across the resistor 33 charges the capacitor 34 through the variable resistor 35. When the voltage across both ends of the capacitor 34 reaches a specified level, the transistor 27 becomes ON. The time period from the start of the flashing to the turning ON of the transistor 27 is defined by the time constant of the RC timer circuit of the capacitor 34 and the variable resistor 35. By the turning ON of the transistor 27, a voltage is produced across the resistor 29, thereby turning the thyristor 21 ON. This turning ON of the thyristor 21 causes the quenching trigger circuit 20 to produce a triggering signal to the quenching discharge tube 9. Therefore the quenching discharge tube 9 turns the thyristor 5 OFF and hence stops the light of the flash tube 4.

Figure 1:
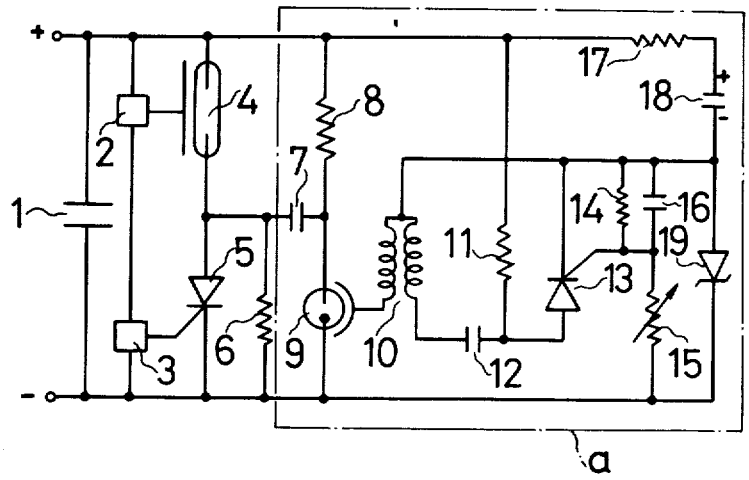
FIG.1 PRIOR ART
FIG. 1 is a circuit diagram of one example of the prior art.
Figure 2:
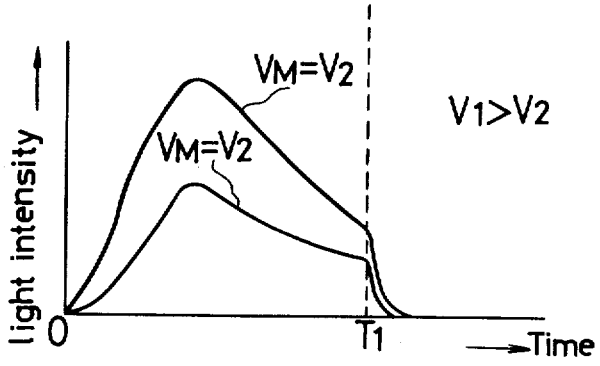
FIG. 2 is a time chart showing curves of intensities of flash lights with normal main capacitor voltage $V_M=V_1$ and with lowered main capacitor voltage $V_M=V_2$.
Figure 4A:
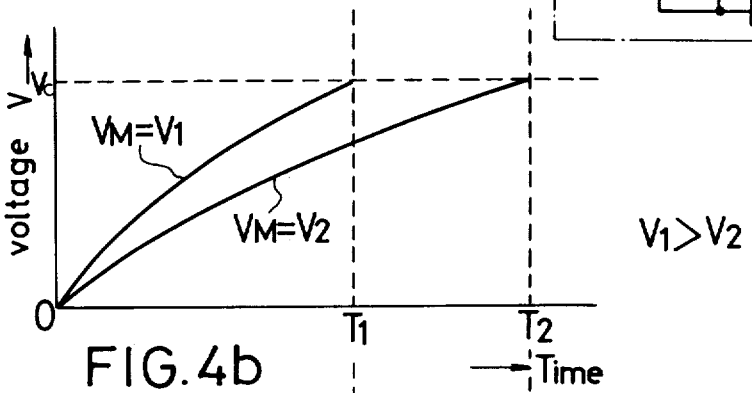
FIG. 4*a* is a time-chart showing curves of voltages $V_1$ and $V_2$ of the capacitor 34 of FIG. 3.
Figure 4B:
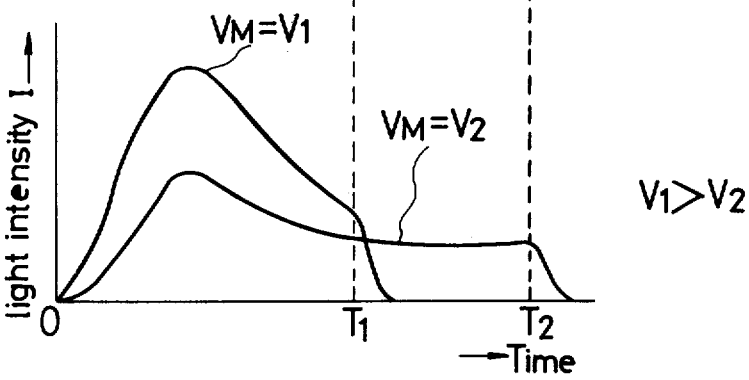
FIG. 4*b* is a time-chart showing curves of intensities of flash lights with normal main capacitor voltage $V_M=V_1$ and with lowered main capacitor voltage $V_M=V_2$.

In the device of the example of FIG. 3, the voltage charged in the capacitor 31 is dependent on (i.e., almost equal to) the voltage of the main capacitor 1, and therefore, the charging up of the capacitor 34 of the CR timer circuit (35+34) is dependent on the voltage of the main capacitor, in contradistinction to the prior art circuit of FIG. 1 wherein the voltage of the capacitor 16 of the CR timer circuit (15+16) is charged by a constant voltage across the zenor diode 19. Since the voltage of the capacitor 31 decreases by a decrease to $V_2$ of the main capacitor voltage, the time-voltage curve $V_M=V_2$ of the charged voltage of the capacitor 34 becomes lower than that of the curve $V_M=V_1$ for the normal voltage $V_1$ of the main capacitor 1. Therefore, the time $T_2$ when the decreased voltage of the capacitor 34, i.e., the voltage of the base of the transistor 27 reaches a specified level to turn the transistor 27 ON is posterior to the time $T_1$ when the normal voltage of the capacitor 34, i.e., the voltage of the base of the transistor 27 reaches the level. Accordingly, as shown in FIG. 4*b*, for a decreased main capacitor voltage $V_2$, the period of flashing becomes longer, while the intensity of the light is lower. In FIG. 4*b*, the curve $V_M=V_1$ is for the normal main capacity voltage and the curve $V_M=V_2$ is for the decreased main capacity voltage. As shown by the curves of both cases, the flashing time period is inversely related to the main capacitor voltage, and therefore the total amounts of light, which are integrals of the light intensities with respect to time, are almost equal irrespective of the variation of the main capacity voltage $V_M$. Therefore, the amount of the flash light is substantially constant irrespective of a decrease of the main capacitor voltage.

Figure 5:
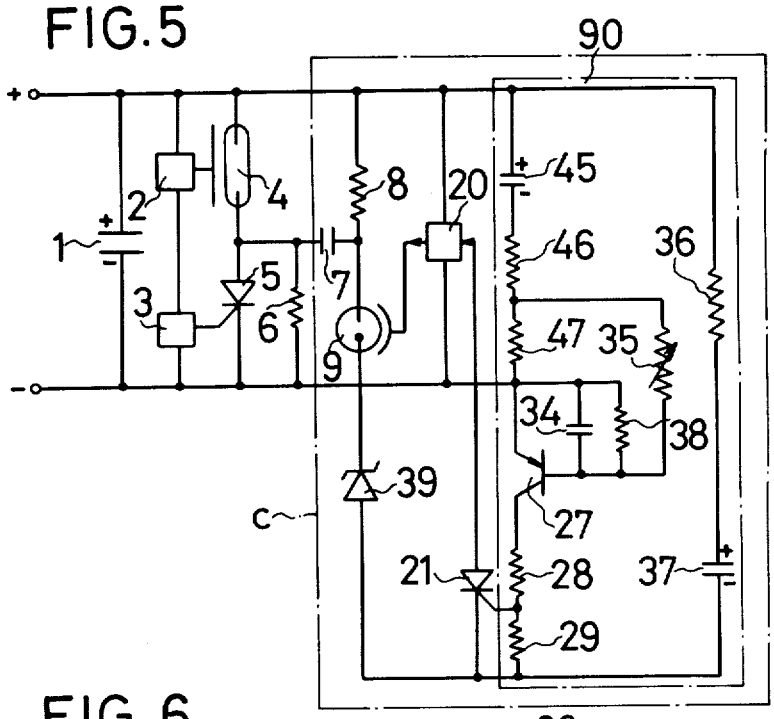
FIG. 5 is a circuit diagram of another example of the present invention.

FIG. 5 shows a modified example. The part other than a light amount controlling circuit "c" is same as that "b" of FIG. 3. In the light amount controlling circuit "c", a series connection of a resistor 8 and a quenching discharge tube 9 are connected in series across the positive and the negative terminals + and −, and the junction point between the quenching discharge tube 9 and the resistor 8 are connected through a capacitor 7 to the junction point between the flash tube 4 and the thyristor 5. A resistor 36, a capacitor 37 and a zenor diode 39 are connected in series across the positive and the negative terminals + and −. Across the anode and the cathode of the zenor diode 39 are connected resistors 29 and 28 and the collector and the emitter of a transistor 27 in series. A thyristor 21 is connected by the cathode to the anode of the zenor diode 39, by the gate to the junction point between two resistors 28 and 29 and by the anode to an input terminal of a quenching triggering circuit 20, which gives a triggering signal to the quenching discharge tube 9 to turn the thyristor 5 off in a known manner. A capacitor 45, a resistor 46 and a resistor 47 are connected in series across the positive terminal + and the negative terminal −. A junction point between the resistor 46 and the resistor 47 is connected through a variable resistor 35 to the base of the transistor 27. A resistor 38 and a capacitor 34 are connected in parallel across the base and the emitter of the transistor 27.

Operation of FIG. 5 circuit is as follows:

The main capacitor 1 is charged by a DC-DC converter not shown in the drawing and hence, the capacitors 37 and 45 are also charged up in the polarity indicated by the marks + and − thereon.

When the thyristor 5 is made ON by means of a thyristor trigger circuit 3, and when a trigger pulse is given to the flash tube 4 from the triggering circuit 2, the flash tube 4 is triggered and starts to discharge electric energy stored in the main capacitor 1. Since the flash tube 4 and the thyristor 5 become ON, the charge of the capacitor 37 is discharged through the resistor 36, the flash tube 4, the thyristor 5 and by the zenor diode 39. Accordingly, the zenor voltage appears across both electrodes of the zenor diode 39 and hence across the collector and the emitter of the transistor 27. At the same time, since the flash tube 4 and the thyristor 5 become ON, the charge of the capacitor 45 is discharged through the flash tube 4, the thyristor 5 and the resistors 47 and 46, thereby producing a voltage across the resistor 47. This voltage is impressed through the resistor 35 on the capacitor 34 and the resistor 38, thereby charging the capacitor 34. When the voltage across both ends of the capacitor 34 reaches a specified level, the transistor 27 becomes ON. The time period from the start of the flashing to the turning ON of the transistor 27 is defined by the time constant of the RC timer circuit of the capacitor 34 and the variable resistor 35. After turning ON of the transistor 27, similarly to the example of FIG. 3, the thyristor 21 turns ON, thereby causing the quenching discharge tube 9 to turn the thyristor 5 OFF and stop the light of the flash tube 4.

Since the voltage charged in the capacitor 45 is dependent on the voltage of the main capacitor 1, the time period of the flashing of the flash tube 4 is inversely related to the voltage of the main capacitor 1, similarly to the foregoing example. Accordingly, the amount of light is kept constant irrespective of the main capacitor voltage.

Figure 6:
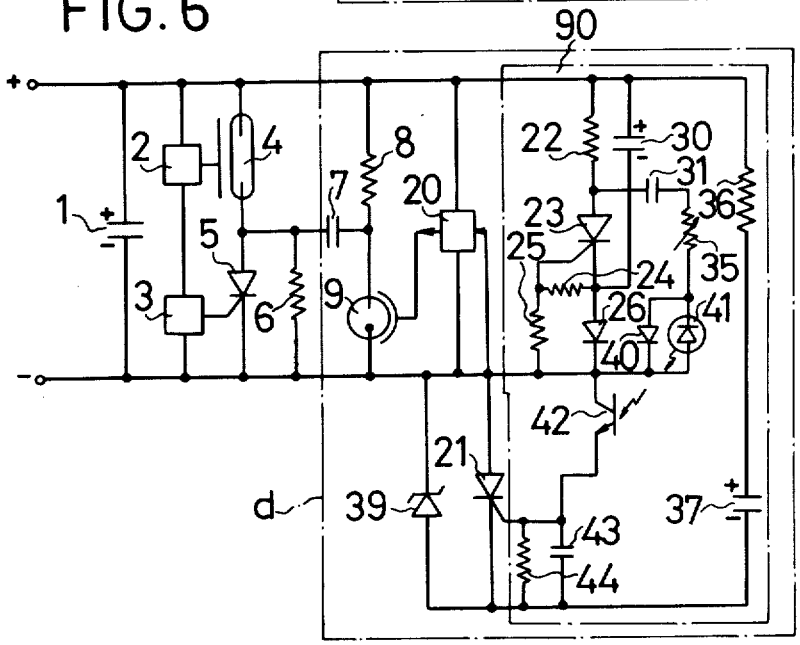
FIG. 6 is a circuit diagram of still another example of the present invention.

FIG. 6 shows still another example of the present invention. The part other than a light amount controlling circuit "d" is same as that "b" of FIG. 3. In the light amount controlling circuit "d", a series connection of a resistor 8 and a quenching discharge tube 9 are connected in series across the positive and the negative terminals + and −, and the junction point between the quenching discharge tube 9 and the resistor 8 are connected through a capacitor 7 to the junction point between the flash tube 4 and the thyristor 5. A resistor 36, a capacitor 37 and a zenor diode 39 are connected in series across the positive and the negative terminals + and −. Across the anode and the cathode of the zenor diode 39 are connected a resistor 44 and a phototransistor 42. A capacitor 43 is connected in parallel with the resistor 44. A thyristor 21 is connected by the cathode to the anode of the zenor diode 39, by the gate to the emitter of the transistor 27 and by the anode to an input terminal of a quenching triggering circuit 20, which gives a triggering signal to the quenching discharge tube 9 to turn the thyristor off in a known manner. A resistor 22, the anode and the cathode of the thyristor 23 and a diode 26 are connected in series across the positive terminal + and the negative terminal −. A capacitor 30 is connected between the positive terminal + and the cathode of the thyristor 23. A capacitor 31, a variable resistor 35 and a light-emitting diode (LED) 41 are connected in series across the anode of the thyristor 23 and the negative terminal −. A diode 40 is connected in parallel with and in opposite direction to the LED 41. The LED 41 and the phototransistor 42 are arranged so as to constitute a photocoupler.

Operation of FIG. 6 circuit is as follows:

The main capacitor 1 is charged by a DC-DC converter not shown in the drawing and hence, the capacitors 37 and 45 are also charged up in the polarity indicated by the marks + and − thereon.

When the thyristor 5 is made ON by means of a thyristor trigger circuit 3, and when a trigger pulse is given to the flash tube from the triggering circuit 2, the flash tube 4 is triggered and starts to discharge electric energy stored in the main capacitor 1. Since the flash tube 4 and the thyristor 5 become ON, the charge of the capacitor 37 is discharged through the resistor 36, the flash tube 4, the thyristor 5 and by the zenor diode 39. Accordingly, the zenor voltage appears across both electrodes of the zenor diode 39 and hence across the collector and the emitter of the phototransistor 42. At the same time, since the flash tube 4 and the thyristor 5 becomes ON, the charge of the capacitor 30 is discharged through the flash tube 4, the thyristor 5, the resistor 25 and the resistor 24, thereby producing a triggering voltage across the resistor 24 hence making the thyristor 23 ON. As a result of the turning ON of the thyristor 23, the charge of the capacitor 31 is discharged through the thyristor 23, the diode 26, the LED 41 and the variable resistor 35, thereby causing the LED 41 to emit a light of a selected intensity, defined by the selected resistance of the variable resistor 35, to the phototransistor 42. Accordingly, the phototransistor 42 becomes ON with its collector-emitter resistance responding with the intensity of the light from the LED 41, thereby charging the capacitor 43 with a time constant responding with the resistance of the variable resistor 35. When the charged voltage across the capacitor 45 i.e., the resistor 44 reaches a specified value, the thyristor 21 becomes ON, and in the similar way with the foregoing examples, stops flashing of the light of the flash tube 4. Namely, the time period of the flashing is controlled by the value of the variable resistance 35.

In the example of FIG. 6, since the voltage charged in the capacitor 31 is dependent on the voltage of the main capacitor 1, the intensity of light from the LED 41. hence the charging current of the capacitor 43 is dependent on the voltage of the main capacitor 1. Accordingly, the time period of the flashing of the light inversely responds with the voltage of the main capacitor 1 like the foregoing examples, and the amount of light is kept constant irrespective of the main capacitor voltage.

As is described in the foregoing examples, the flash device according to the present invention perform flashing with a selected constant amount of light irrespective of the change of voltage of the main capacitor 1.

Though the foregoing examples relate to the flash devices of the type wherein the flash tube is connected in series with the switching device such as the thyristor 5, the present invention is also applicable for the flash devices of another type wherein the flash tube is connected in parallel with a switching device, for example disclosed in the U.S. Pat. No. 3,033,986.

What I claim is:

1. In a photographic flash device comprising a gas discharge flash tube, a main capacitor which stores electric charge to be fed to said gas discharge flash tube, and a stopping circuit which stops discharging of said gas discharge flash tube after a selected time period from a start of the flashing, the improvement wherein said stopping circuit includes a circuit which adjusts said time period in response to a voltage of said main capacitor and comprises discharge stopping means, triggering circuit means which sends a triggering signal to said discharge stopping means to stop a discharging of said gas discharge flash tube, first switching means which sends a signal to said triggering circuit means to cause it to produce a triggering signal, controlling circuit means which adjusts the time when said switching means sends said signal, said controlling circuit means including a first capacitor which is charged to a voltage dependent on the voltage of said main capacitor, second switching means which turns on based on a discharging in said flash tube and discharges the charge of said first capacitor, a second capacitor which is charged by a voltage produced by the discharging of said first capacitor, an RC time constant circuit comprising said second capacitor and a variable resistor through which said charging of said second capacitor is made and with which a setting of a selection of said time period is made, and a triggering circuit which triggers said first switching means when said second capacitor is charged up to a specified voltage.

2. In a photographic flash device comprising a gas discharge flash tube, a main capacitor which stores electric charge to be fed to said gas discharge flash tube, and a stopping circuit which stops discharging of said gas discharge flash tube after a selected time period from a start of the flashing, the improvement wherein said stopping circuit includes a circuit which adjusts said time period in response to a voltage of said main capacitor and comprises discharge stopping means, triggering circuit means which sends a triggering signal to said discharge stopping means to stop a discharging of said gas discharge flash tube, first switching means which sends a signal to said triggering circuit means to cause it to produce a triggering signal, controlling circuit means which adjusts the time when said switching means sends said signal, said controlling circuit means including a first capacitor which is charged to a voltage dependent on the voltage of said main capacitor and is discharged based on a discharging in said flash tube, a resistor which produces a voltage thereacross by said discharging of said first capacitor, a second capacitor which is charged by a voltage produced across said resistor, a variable resistor through which a current is fed from one end of said resistor to said second capacitor, and a triggering circuit which triggers said first switching means when said second capacitor is charged up to a specified voltage.

3. In a photographic flash device comprising a gas discharge flash tube, a main capacitor which stores electric charge to be fed to said gas discharge flash tube, and a stopping circuit which stops discharging of said gas discharge flash tube after a selected time period from a start of the flashing, the improvement wherein said stopping circuit includes a circuit which adjusts said time period in response to a voltage of said main capacitor and comprises discharge stopping means, triggering circuit means which sends a triggering signal to said discharge stopping means to stop a discharging of said gas discharge flash tube, first switching means which sends a signal to said triggering circuit means to cause it to produce a triggering signal, controlling circuit means which adjusts the time when said switching means sends said signal, said controlling circuit means including a first capacitor which is charged to a voltage dependent on the voltage of said main capacitor, second switching means which turns on based on a discharging in said flash tube and discharges the charge of said first capacitor, a variable resistor which controls the discharging current of said first capacitor, a light-emitting diode which is connected to emit a light by said discharging current of said first capacitor, a triggering circuit comprising a photoelectric element which receives light from said light-emitting diode and produces an electric signal responding to intensity of said light and triggers said first switching means.

4. In a photographic flash device including a gas discharge flash tube, a main capacitor which stores electric charge to be fed to said gas discharge flash tube, and a stopping circuit which stops discharging of said gas discharge flash tube after a selected time period from a start of the flashing, the improvement wherein said stopping circuit includes a circuit which adjusts said time period in response to a voltage of said main capacitor and comprises, discharge stopping means, triggering circuit means which sends a triggering signal to said discharge stopping means to stop a discharging of said gas discharge flash tube, controlling circuit means operative in response to said voltage of said main capacitor for adjusting the time when said triggering circuit sends said signal, said controlling circuit means comprising:

a first capacitor which is charged to a voltage dependent on the voltage of said main capacitor, a first switching means which turns on based on a discharging in said flash tube and discharges the charge of said first capacitor, a second capacitor which is charged by a voltage produced by the discharging of said first capacitor, an RC time constant circuit comprising said second capacitor and a variable resistor through which said charging of said second capacitor is made and with which a setting of a selection of said time period is made, and second switching means which triggers said triggering circuit means when said second capacitor is charged up to a specified voltage.

5. In a photographic flash device including a gas discharge flash tube, a main capacitor which stores electric charge to be fed to said gas discharge flash tube, and a stopping circuit which stops discharging of said gas discharge flash tube after a selected time period from a start of the flashing, the improvement wherein said stopping circuit includes a circuit which adjusts said time period in response to a voltage of said main capacitor and comprises, discharge stopping means, triggering circuit means which sends a triggering signal to said discharge stopping means to stop a discharging of said gas discharge flash tube, controlling circuit means operative in response to said voltage of said main capacitor for adjusting the time when said triggering circuit sends said signal, said controlling circuit means comprising:

a first capacitor which is charged to a voltage dependent on the voltage of said main capacitor and is discharged based on a discharging in said flash tube, a resistor which produces a voltage thereacross by said discharging of said first capacitor, a second capacitor which is charged by a voltage produced across said resistor, a variable resistor through which a current is fed from one end of said resistor to said second capacitor and a switching circuit which triggers said triggering circuit means when said second capacitor is charged up to a specified voltage.

6. In a photographic flash device including a gas discharge flash tube, a main capacitor which stores electric charge to be fed to said gas discharge flash tube, and a stopping circuit which stops discharging of said gas discharge flash tube after a selected time period from a start of the flashing, the improvement wherein said stopping circuit includes a circuit which adjusts said time period in response to a voltage of said main capacitor and comprises, discharge stopping means, triggering circuit means which sends a triggering signal to said discharge stopping means to stop a discharging of said gas discharge flash tube, controlling circuit means operative in response to said voltage of said main capacitor for adjusting the time when said triggering circuit sends said signal, said controlling circuit means comprising:

a first capacitor which is charged to a voltage dependent on the voltage of said main capacitor, first switching means which turns on based on a discharging in said flash tube and discharges the charge of said first capacitor, a variable resistor which controls the discharging current of said first capacitor, a light-emitting diode which is connected to emit a light by said discharging current of said first capacitor, a second switching means comprising a photoelectric element which receives light from said light-emitting diode and produces an electric signal responding to intensity of said light and triggers said triggering circuit means.

* * * * *